US006281809B1

(12) United States Patent
Potter, Sr.

(10) Patent No.: US 6,281,809 B1
(45) Date of Patent: Aug. 28, 2001

(54) VEHICLE DETECTOR WITH AUDIBLE CALL SIGNAL INDICATOR

(76) Inventor: Thomas R. Potter, Sr., 2260 Applewood Ct., Reno, NV (US) 89509

( * ) Notice: Subject to any disclaimer, the term of this patent is extended or adjusted under 35 U.S.C. 154(b) by 0 days.

(21) Appl. No.: 09/523,917

(22) Filed: Mar. 9, 2000

(51) Int. Cl.[7] ..... G08G 1/01

(52) U.S. Cl. ..... 340/933; 340/941; 340/540

(58) Field of Search ..... 340/540, 686.1, 340/332, 326, 384.1, 933, 941

(56) References Cited

U.S. PATENT DOCUMENTS 4,566,008 * 1/1986 Powers et al. ..... 340/941

* cited by examiner

*Primary Examiner*—Daryl Pope

(57) ABSTRACT

A method and apparatus for visually and audibly verifying Call signal generation in a vehicle detector. A generated Call signal drives a visible display, such as a discrete LED, an LED display composed of multiple discrete LEDs, or an LCD display. The same generated Call signal also controls the operation of an audible tone generator so that an audible tone is generated whenever the vehicle detector generates a Call signal. The audible tone generation permits a single technician in the field to check the vehicle detector for correct Call signal generation in response to vehicle movement in the vicinity of the associated detector loop

15 Claims, 2 Drawing Sheets

VEHICLE DETECTOR WITH AUDIBLE CALL SIGNAL INDICATOR

BACKGROUND OF THE INVENTION

This invention relates to vehicle detectors used to detect the presence or absence of a motor vehicle in an inductive loop embedded in a roadbed. More particularly, this invention relates to a vehicle detector with an audible Call signal indicator.

Vehicle detectors have been used for a substantial period of time to generate information specifying the presence or absence of a vehicle at a particular location. Such detectors have been used at intersections, for example, to supply information used to control the operation of the traffic signal heads, and have also been used to supply control information used in conjunction with automatic entrance and exit gates in parking lots, garages and buildings. A widely used type of vehicle detector employs the principle of period shift measurement in order to determine the presence or absence of a vehicle in or adjacent the inductive loop mounted on or in a roadbed. In such systems, a first oscillator, which typically operates in the range from about 10 to about 120 kHz is used to produce a periodic signal in a vehicle detector loop. A second oscillator operating at a much higher frequency is commonly used to generate a sample count signal over a fixed number of loop cycles. The relatively high frequency count signal is typically used to increment a counter, which stores a number corresponding to the sample count at the end of the fixed number of loop cycles. This sample count is compared with a reference count stored in another counter and representative of a previous count in order to determine whether a vehicle has entered or departed the region of the loop in the time period between the previous sample count and the present sample count.

The initial reference value is obtained from one or more initial sample counts and stored in a reference counter. Thereafter, successive sample counts are obtained on a periodic basis, and compared with the reference count. If the two values are essentially equal, the condition of the loop remains unchanged, i.e., a vehicle has not entered or departed the loop. However, if the two numbers differ by at least a threshold amount in a first direction (termed the Call direction), the condition of the loop has changed and may signify that a vehicle has entered the loop. More specifically, in a system in which the sample count has decreased and the sample count has a numerical value less than the reference count by at least a threshold magnitude, this change signifies that the period of the loop signal has decreased (since fewer counts were accumulated during the fixed number of loop cycles), which in turn indicates that the frequency of the loop signal has increased, usually due to the presence of a vehicle in or near the loop. When these conditions exist, the vehicle detector generates a signal termed a Call Signal indicating the presence of a vehicle in the loop.

Correspondingly, if the difference between a sample count and the reference count is greater than a second threshold amount, this condition indicates that a vehicle which was formerly located in or near the loop has left the vicinity. When this condition occurs, a previously generated Call Signal is dropped.

The Call signals generated by a vehicle detector are used in a number of ways. Firstly, the Call signals are presented to an output terminal of the vehicle detector and forwarded to various types of traffic signal supervisory equipment for use in a variety of ways, depending on the system application. In addition, the Call signals are used locally to drive a visual indicator, typically a discrete light emitting diode (LED) or a multiple LED display or a liquid crystal display (LCD) to indicate the Call status of the vehicle detector, i.e. whether or not the vehicle detector is currently generating a Call signal.

Vehicle detectors with the Call signal generating capability described above are used in a wide variety of applications, including vehicle counting along a roadway or through a parking entrance or exit, vehicle speed between preselected points along a roadway, vehicle presence at an intersection controlled by a traffic control light system, or in a parking stall, and numerous other applications. In all applications, a vehicle detector must be initially set up at the desired location by a qualified technician. Initial set up involves physically installing the detector unit into the housing provided (typically, a metal cabinet already present at the location), choosing certain detector parameters, such as loop frequency and detector sensitivity (typically by means of selector switches), and checking the operation of the detector in response to various vehicular conditions to verify that the detector has been installed correctly and is functioning in a correct fashion. Similarly, from time to time vehicle detectors must be checked for proper operation, and re-initialized, typically after a detector failure has been observed, either momentarily or permanently.

When initially setting up a vehicle detector, and when re-indicator to verify that the vehicle detector is operating in the proper manner by generating a Call signal when a vehicle enters the detector loop and dropping the Call signal after the detected vehicle leaves the detector loop. The technician performs this verification by observing the entry and departure of vehicles to and from the vicinity of the detector loop while simultaneously visually monitoring the state of the vehicle detector Call signal visible indicator. This visual observation is not always easily accomplished. In the presence of direct sunlight during the daytime, for example, the technician may have difficulty in visually determining whether or not an LED is illuminated. At night time, a technician cannot see an LCD unless back lighting is incorporated into the LCD display. More importantly, in a large number of vehicle detector installations the Call signal visible indicator device (LED or LCD) cannot easily be viewed by a technician while at the same time visually observing the flow of traffic through the lane associated to the vehicle detector, due to the physical placement of the vehicle detector unit relative to the detector loop. While this impediment can be overcome by sending two technicians to the vehicle detector site—one to observe the vehicle flow through the loop and the other to monitor the Call signal visible indicator—this is costly and does not address the possible visibility problems noted above regarding LEDs in direct sunlight and LCDs in darkness.

SUMMARY OF THE INVENTION

The invention comprises a vehicle detector system which solves the problem of relying entirely on visible indicators to verify Call signal generation performance when initially setting up a vehicle detector and when subsequently checking the detector performance.

From an apparatus standpoint the invention comprises a vehicle detector having circuitry powered by a source of electrical power for sensing changes in an associated inductive loop related to the presence of a vehicle in the vicinity of the loop and for generating a Call signal in response to such changes, means for visibly indicating the state of the Call signal, and sound means for generating an audible indication of the state of the Call signal. The sound means for generating an audible indication of the Call signal preferably comprises a sound transducer which is energized to produce an audible tone whenever a Call signal is generated.

In one alternate embodiment of the invention, the vehicle detector is a multi-channel detector having circuitry for generating Call signals for each channel; and the sound means includes a plurality of indicator units each dedicated to a specific one of the channels for generating an audible indication of the state of the Call signal for the associated channel. In another alternate embodiment of the invention, each of the plurality of indicator units has a tone generator for generating a tone having a pitch unique to the associated channel.

In still another embodiment of the invention, the vehicle detector is a multi-channel detector having circuitry for generating Call signals for each channel; and each sound means includes a multiplexer unit having a plurality of input terminals each coupled to a different channel Call signal, and a single tone generator coupled to the multiplexer unit for generating an audible tone whenever one of the channel Call signals is asserted.

In another alternate embodiment of the invention the vehicle detector is a multi-channel detector having circuitry for generating Call signals for each channel; and the sound means includes a multiplexer unit having a plurality of input terminals each coupled to a different channel Call signal, and a variable tone generator coupled to the multiplexer unit for generating an audible tone having a pitch unique to a given channel whenever a channel Call signal for that given channel is asserted.

In another embodiment of the invention the vehicle detector is a multi-channel detector having circuitry for generating Call signals for each channel; and the sound means includes a tone generator for generating an audible tone when activated, and a channel selector unit having a plurality of input terminals each coupled to a different channel Call signal, a control input terminal for receiving a Channel Select control signal specifying a given selected channel, an output terminal for activating the tone generator, and means for preventing any channel other than the selected channel from activating the tone generator.

The invention further includes a time-out circuit for disabling the sound means after a predetermined time period.

From a process standpoint the invention comprises a method of audibly indicating the generation of a Call signal in a vehicle detector system having circuitry powered by a source of electrical power for sensing changes in an associated inductive loop related to the presence of a vehicle in the vicinity of the loop and for generating a Call signal in response to such changes, the method including the step of using a generated Call signal to activate a sound transducer to audibly indicate the generation of the Call signal in response to the entry of a vehicle in the loop. When applied to a system in which the detector is a multi-channel detector having circuitry for generating Call signals for each channel, the method includes the step of providing a plurality of audible indicator units each dedicated to a specific one of the channels for generating an audible indication of the state of the Call signal for the associated channel. The step of providing a plurality of audible indicator units may include the step of generating a tone having a pitch unique to the channel associated to a given audible indicator unit.

The step of using a generated Call signal to activate a sound transducer to audibly indicate the generation of the Call signal in response to the entry of a vehicle in the loop may further include the step of using a multiplexer unit having a plurality of input terminals each coupled to a different channel Call signal, and a single tone generator coupled to the multiplexer unit to generate an audible tone whenever one of the channel Call signals is asserted. This alternate embodiment of the invention may further include the use of a variable tone generator coupled to the multiplexer unit to generate an audible tone having a pitch unique to a given channel whenever a channel Call signal for that given channel is asserted.

The step of using a generated Call signal to activate a sound transducer to audibly indicate the generation of the Call signal in response to the entry of a vehicle in the loop in a multi-channel detector implementation may further include the step of specifying a given channel for exclusively activating the sound transducer while preventing any channel other than the selected channel from activating the sound transducer.

The invention may further include the step of disabling the sound transducer a predetermined time period after activation.

Vehicle detectors incorporating the invention eliminate the need for a backup technician to assist in the process of initially setting up a vehicle detector or checking the operation of a previously installed vehicle detector. In addition, vehicle detectors incorporating the invention eliminate the problems noted above associated with relying entirely on a visual indication of the Call signal status when verifying the operation of a vehicle detector.

For a fuller understanding of the nature and advantages of the invention, reference should be had to the ensuing detailed description taken in conjunction with the accompanying drawings.

DETAILED DESCRIPTION OF THE PREFERRED EMBODIMENTS

Figure 1:
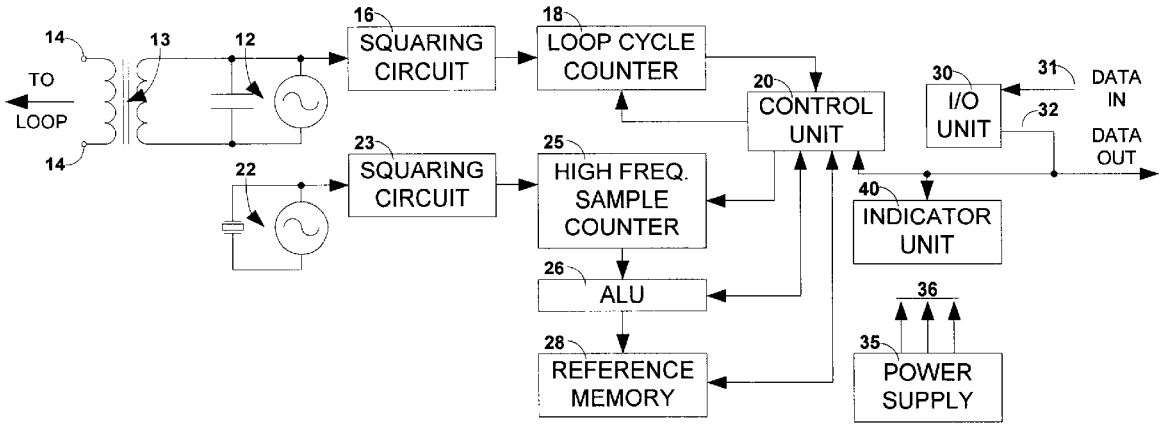
FIG. 1 is a block diagram of a vehicle detector incorporating the invention.

Turning now to the drawings, FIG. 1 is a block diagram of a vehicle detector incorporating the invention. As seen in this figure, an oscillator 12 operable over a frequency range of about 10 to about 120 kHz is coupled via a transformer 13 to a pair of output terminals 14. Output terminals 14 are adapted for connection to an inductive loop usually mounted within the roadbed in a position such that vehicles to be sensed will pass over the loop. Such loops are well-known and are normally found installed at controlled locations in the highway system, such as at intersections having signal heads controlled by a local intersection unit, parking lots with controlled access, security barrier installations and the like.

The oscillator circuit 12 is coupled via a squaring circuit 16 to a loop cycle counter 18. Loop cycle counter 18 typically comprises a multi-stage binary counter having a control input for receiving appropriate control signals from a control unit 20 and a status output terminal for providing appropriate status signals to the control unit 20, in the manner described below.

A second oscillator circuit 22, which typically generates a precise, crystal controlled, relatively high frequency clock signal (e.g., a 6 mHz clock signal) is coupled via a second squaring circuit 23 to a second binary counter 25. Counter 25 is typically a multi-stage counter having a control input for receiving control signals from control unit 20 and a count state output for generating signals representative of the count state of counter 25 at any given time. The count state of counter 25 is coupled as one input to an arithmetic logic unit 26. The other input to arithmetic logic unit 26 is one or more reference values stored in a reference memory 28. Reference memory 28 is controlled by appropriate signals from control unit 20 in the manner described below.

An input/output unit 30 is coupled between the control unit 20 and externally associated circuitry. I/O unit 30 accepts appropriate control signals via an upper input path 31 to specify the control parameters for the vehicle detector unit of FIG. 1, such as mode, sensitivity, and any special features desired. I/O unit 30 furnishes data output signals via lower path 32, the data output signals typically comprising Call signals indicating the arrival or departure of a vehicle from the vicinity of the associated loop.

Initially, control unit 20 supplies control signals to loop cycle counter 18 which define the length of a sample period for the high frequency counting circuit comprising elements 22, 23 and 25. For example, if control unit 20 specifies a sample period of six loop cycles, loop cycle counter 18 is set to a value of six and, when the sample period is to commence, control unit 20 permits loop cycle counter 18 to begin counting down from the value of six in response to the leading edge of each loop cycle signal furnished via squaring circuit 16 from loop oscillator circuit 12. Contemporaneously with the beginning of the countdown of the loop cycle counter 18, control unit 20 enables high frequency counter 25 to accumulate counts in response to the high frequency signals received from high frequency oscillator circuit 22 via second squaring circuit 23. At the end of the sample period (i.e., when the loop cycle counter has been counted down to zero), control unit 20 generates a disable signal for the high frequency counter 25 to freeze the value accumulated therein during the sample period. Thereafter, this sample count value is transferred to the ALU 26 and compared with the value stored in a reference memory 28, all under control of control unit 20. After the comparison has been made, the sample process is repeated.

The reference value in reference memory 28 is a value representative of the inductance of the loop oscillator circuit comprising elements 12–14 (and the associated loop) at some point in time. The reference is updated at the end of certain periods in response to certain comparisons involving the reference stored in memory 28 and successively obtained samples from counter 25. Whenever the difference between a given sample from counter 25 and the reference from memory 28 exceeds a first threshold value in the Call direction, the control unit 20 senses this condition and causes the generation of an output signal—termed a Call signal—on conductor 32 indicating the arrival of a vehicle within the loop vicinity. Similarly, when the difference between a given sample and the previous reference exceeds a second threshold in the No Call direction the control unit 20 senses this condition and causes the Call output signal on conductor 32 to be dropped. In the preferred embodiment, the Call direction is negative and the Call direction threshold value is −8 counts; while the No Call threshold value is −5 counts.

Power is supplied to the system elements depicted in FIG. 1 from a dedicated power supply 35 via appropriate power conductors suggested by arrows 36. Power supply 35 typically provides DC voltage to the electronic circuit components comprising the vehicle detector, and is usually powered by either AC or DC electrical power available at the installation site of the vehicle detector.

Call signal conductor 32 is coupled to an indicator unit 40 having a visible indicator and an audible indicator, described in detail below with reference to FIG. 2. Whenever the Call signal is asserted, both the visible indicator and the audible indicator of indicator unit 40 are activated. Whenever the Call signal is de-asserted, both the visible indicator and the audible indicator are de-activated.

Figure 2:
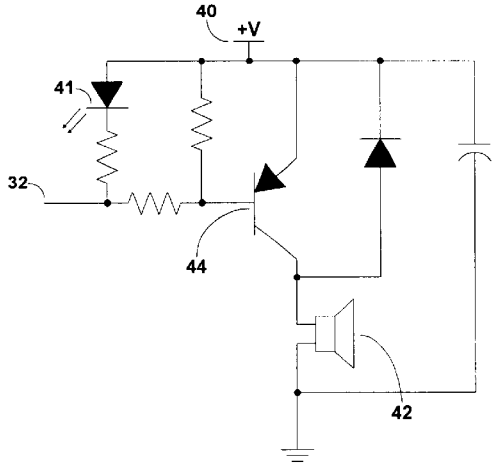
FIG. 2 is a circuit diagram of the visible indicator and audible indicator according to the invention.

With reference to FIG. 2, call indicator unit 40 includes a visible indicator 41 and an audible indicator 42. In the preferred embodiment, visible indicator 41 comprises a light emitting diode (LED) of the type typically used in vehicle detectors. Audible indicator 42 preferably comprises any suitable sound transducer capable of generating an audible tone when activated. One example of such a device is a type EMX-7T06SP transducer available from NINGBO EAST ELECTRONICS LTD. Of NingBo, China. Other suitable transducers will be apparent to those skilled in the art.

Visible indicator 41 is controlled directly by the state of the Call signal on conductor 32. When a Call signal is asserted on conductor 32, D.C. current flows through visible indicator 41, causing this element to be illuminated. Audible indicator 42 is controlled by a transistor 44 having a base input coupled to Call signal conductor 32. Whenever a Call signal is asserted on conductor 32, transistor 44 is turned on, thereby enabling D.C. current to flow through audible indicator 42. As a result, whenever a Call signal is asserted on conductor 32 LED 41 is illuminated and audible indicator 42 is activated, thereby producing an audible tone. When the Call signal on conductor 32 is deasserted, LED 41 is extinguished and transistor 44 is turned off, which deactivates audible indicator 42, thereby terminating the audible tone generation.

While visible indicator 41 is depicted in FIG. 2 as a discrete LED, detectors are known which incorporate a message type display using an array of several discrete LEDs. In such detectors, the Call signal state is indicated by displaying the word "CALL" by activating appropriate ones of the LEDs in the array whenever the vehicle detector generates a Call signal. In such detectors, the audible indicator 42 may be activated using the same control signal used to display the word "CALL". Similarly, vehicle detectors are known which incorporate a message type display using a liquid crystal display to display the word "CALL" whenever the vehicle detector generates a Call signal. In such detectors, the audible indicator 42 may be activated using the same control signal used to display the word "CALL".

Figure 3:
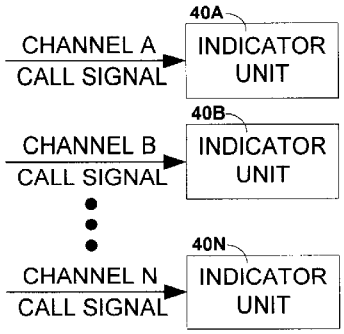
FIG. 3 is a block diagram of an embodiment of the invention having a plurality of indicator units each dedicated to a different one of a plurality of channels in a multi-channel vehicle detector.

The vehicle detector illustrated in FIG. 1 is a single channel detector having one transformer 13 and associated loop. Vehicle detectors are known which incorporate two or more channels, i.e. two or more transformers 13 and associated loops. In such multiple channel detectors, the invention may be implemented in a variety of ways. For example, the detector may be provided with a plurality of audible indicators 42 equal in number to the number of channels, with each audible indicator 42 dedicated to a single given channel. The plurality of audible indicators 42 may all be identical in configuration and thus generate the same tone (tones having the same pitch). Alternatively, each audible indicator 42 may be configured to generate a unique tone distinctive to that channel, so that a technician can audibly distinguish not only the generation of a Call signal but also the channel which is actively generating the Call signal. Both arrangements are illustrated in FIG. 3 in which a plurality of indicator units 40A, 40B, . . . , 40N are each controlled by separate channel Call signals CHANNEL A CALL SIGNAL, CHANNEL B CALL SIGNAL, . . . , CHANNEL N CALL SIGNAL (where N is the number of channels controlled by the vehicle detector). Indicator units 40A, 40B, . . . , 40N may all incorporate identical audible indicators 42 each having tones of the same pitch, or individual audible indicators 42 each having tones of a different and distinct pitch.

Figure 4:
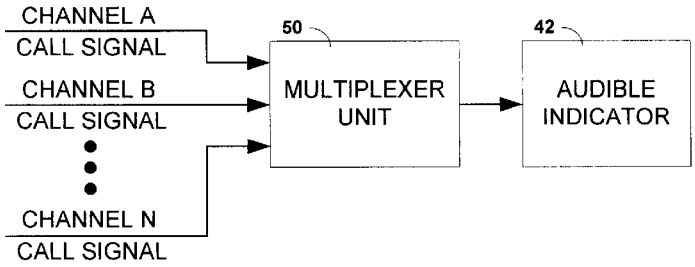
FIG. 4 is a block diagram of an embodiment of the invention having a single indicator unit responsive to a plurality of channels in a multi-channel vehicle detector.

FIG. 4 illustrates an embodiment of the invention in which a single audible indicator 42 is used in a multiple channel vehicle detector to generate an audible tone whenever any channel has a Call signal asserted. As seen in this FIG., Call signals from each of the detector channels are coupled to a multiplexer unit 50. Whenever any one of the Call signals from any of the channels is asserted, the audible indicator 42 is driven by the output of multiplexer unit 50.

Figure 5:
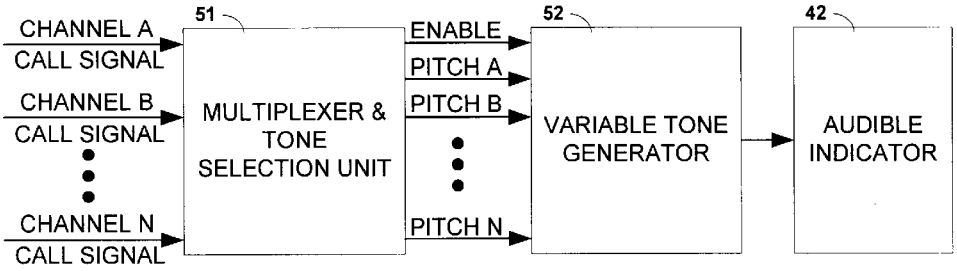
FIG. 5 is a block diagram of an embodiment of the invention having a single variable tone generator responsive to a plurality of channels in a multi-channel vehicle detector for generating tones of different pitches each unique to a different channel.

FIG. 5 illustrates another embodiment of the invention in which a single variable tone generator 52 capable of generating tones of different pitches is used in a multiple channel vehicle detector to generate audible tones of different pitch whenever any channel has a Call signal asserted. As seen in this FIG., Call signals from each of the detector channels are coupled to a multiplexer and tone selection unit 51. Unit 51 has an ENABLE output and several pitch selection outputs labelled "PITCH A", "PITCH B", . . . , "PITCH N". The ENABLE output and the several pitch selection outputs are coupled to a variable pitch tone generator 52. Whenever the ENABLE output and one of the pitch selection outputs are asserted, variable pitch tone generator 52 generates a tone whose pitch is unique to the channel which is currently generating a Call Signal.

Figure 6:
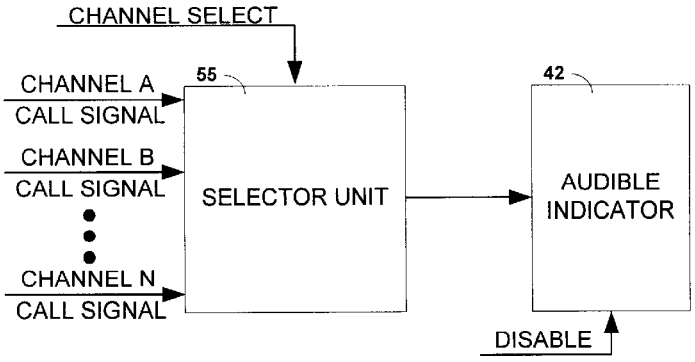
FIG. 6 is a block diagram of an embodiment of the invention having a single tone generator responsive to a selected one of a plurality of channels in a multi-channel vehicle detector while preventing any other channel from activating the tone generator.

In some multi-channel vehicle detector applications it can be both useful and desirable to permit audible tone generation for only a single selected channel at a given time. For example, when a technician is setting up a four channel vehicle detector at a given intersection, verification of proper Call signal generation is normally done one channel at a time by selecting a given channel using panel mounted switches provided for that purpose. To avoid confusion, it is desirable to lock out all other non-selected channels from the tone generation process, so that the technician can rely on the state of the tone generator in verifying proper Call signal operation by the selected channel. FIG. 6 is a block diagram of an embodiment of the invention having this capability. As seen in this FIG., a selector unit 55 has a plurality of input terminals for receiving Call signals from a plurality of channels—specifically, CHANNEL A CALL SIGNAL, CHANNEL B CALL SIGNAL, . . . , CHANNEL N CALL SIGNAL. The output of selector unit 55 is coupled to the input of an audible indicator 42. Selector unit 55 also has a CHANNEL SELECT input for receiving signals from control unit 20 which indicate the fact that a given channel has been selected. When a CHANNEL SELECT input signal is present, only Call signals from that channel are permitted by selector unit 55 to activate audible indicator 42. Any Call signal present on the other input terminals have no effect on the operation of audible indicator 42. In this way, the embodiment of FIG. 6 provides mutually exclusive Call input signal selection at any given time.

In many applications, it can be desirable to provide an automatic time-out feature which disables the tone generation process after a predetermined period of time. This feature is particularly useful in field installations when a technician has left the area after having performed an audible tone verification of the Call signal generation process for one or more detector channels but has forgotten to manually deactivate this function. Again with reference to FIG. 6, audible indicator 42 is provided with a control input terminal to which a DISABLE signal can be supplied from control unit 20. A time-out counter (not shown) is started whenever the tone generation process is started and restarted when another channel is selected or the same channel is re-selected. If no other channel is selected for a predetermined period of time (measured by the time-out period of the counter) after the start of the tone generation process, or if the same channel is not re-selected during that time period, a DISABLE signal is asserted and audible indicator 42 is disabled. The predetermined time period should be long enough so as not to interfere with the audible tone verification process—a period of fifteen minutes is suitable for most applications. It is understood that the time-out feature can be incorporated with each of the several embodiments illustrated and described herein.

While the invention may be implemented with a variety of electronic hardware and software devices, in the preferred embodiment the implementation has been done using a type 17C44 processor available from Microchip Corp. of Chandler, Ariz.

As will now be apparent to those skilled in the art, vehicle detectors provided with the supplemental audible tone generation feature of the invention eliminate the problems encountered in the past when attempting to verify Call signal generation of a vehicle detector during initial set up or when re-initializing detector operation. More particularly, Call signal operation can be verified by a single technician by aurally noting the generation of a Call signal in response to the arrival of a vehicle in a detector loop, and by aurally noting the termination of a Call signal in response to the departure of a vehicle from the vicinity of the detector loop. The audible tone generation eliminates the formerly required need for the technician to visually monitor both the flow of traffic through the detector loop location and the LED or LCD display mounted on the vehicle detector. As a result, verification of correct or incorrect Call signal generation of a vehicle detector can be done quickly and efficiently. Moreover, this feature can be provided at extremely low cost in a vehicle detector, requiring only the addition of a relatively low cost transducer 42 and a few discrete components to a conventional vehicle detector unit.

Although indicator unit 40 has been described and illustrated as providing simultaneous operation of both the visible indicator 41 and the audible indicator 42, in some applications it may be desirable to configure indicator unit to 40 to permit independent operation of the visible and audible indicators. This can be easily done by providing two separate Call signals for each given channel-one Call signal dedicated to the operation of the visible indicator 41; the other Call signal dedicated to the operation of the audible indicator 42. In such an arrangement, various visible indications which show the operation of different timing functions (e.g. delay, extension, and the like) by flashing the visible indicator 41 at a particular rate can still be functionally incorporated into the detector and used without affecting the operation of the audible indicator 42. Stated differently, the audible indicator 42 can be used to signify the state of the Call signal when checking the Call signal operation of the vehicle detector, and silenced otherwise.

Although the above provides a full and complete disclosure of the preferred embodiments of the invention, various modifications, alternate constructions and equivalents will occur to those skilled in the art. For example, if desired additional circuitry may be added to the tone generating portion of the vehicle detector to provide a pulsating tone, or to enable adjustment of the volume of the tone. Therefore, the above should not be construed as limiting the invention, which is defined by the appended claims.

What is claimed is:

1. In a vehicle detector having circuitry powered by a source of electrical power for sensing changes in an associated inductive loop related to the presence of a vehicle in the vicinity of the loop and for generating a Call signal in response to such changes, and means for visibly indicating the state of the Call signal, the improvement comprising sound means for generating an audible indication of the state of the Call signal, said sound means for generating an audible indication of the state of the Call signal preferably comprising a sound transducer which is energized to produce an audible tone whenever a Call signal is generated.

2. The invention of claim 1 wherein said sound means for generating an audible indication of the state of the Call signal preferably comprises a sound transducer which is energized to produce an audible tone whenever a Call signal is generated.

3. The invention of claim 1 wherein said vehicle detector is a multi-channel detector having circuitry for generating Call signals for each channel; and wherein said sound means includes a plurality of indicator units each dedicated to a specific one of the channels for generating an audible indication of the state of the Call signal for the associated channel.

4. The invention of claim 3 wherein each of said plurality of indicator units has a tone generator for generating a tone having a pitch unique to the associated channel.

5. The invention of claim 1 wherein said vehicle detector is a multi-channel detector having circuitry for generating Call signals for each channel; and wherein said sound means includes a multiplexer unit having a plurality of input terminals each coupled to a different channel Call signal, and a single tone generator coupled to said multiplexer unit for generating an audible tone whenever one of said channel Call signals is asserted.

6. The invention of claim 1 wherein said vehicle detector is a multi-channel detector having circuitry for generating Call signals for each channel; and wherein said sound means includes a multiplexer unit having a plurality of input terminals each coupled to a different channel Call signal, and a variable tone generator coupled to said multiplexer unit for generating an audible tone having a pitch unique to a given channel whenever a channel Call signal for that given channel is asserted.

7. The invention of claim 1 wherein said vehicle detector is a multi-channel detector having circuitry for generating Call signals for each channel; and wherein said sound means includes a tone generator for generating an audible tone when activated, and a channel selector unit having a plurality of input terminals each coupled to a different channel Call signal, a control input terminal for receiving a Channel Select control signal specifying a given selected channel, an output terminal for activating said tone generator, and means for preventing any channel other than the selected channel from activating said tone generator.

8. The invention of claim 1 further including a time-out circuit for disabling said sound means after a predetermined time period.

9. A method of facilitating the verification of Call signal generation by a vehicle detector by audibly indicating the generation of a Call signal in a vehicle detector system having circuitry powered by a source of electrical power for sensing changes in an associated inductive loop related to the presence of a vehicle in the vicinity of the loop and for generating a Call signal in response to such changes, and means for visibly indicating the state of the Call signal; the method including the steps of Providing a sound transducer in the vehicle detector, and using a generated Call signal to activate the sound transducer to audibly indicate the generation of the Call signal in response to the entry of a vehicle in the loop.

10. The invention of claim 9 wherein said vehicle detector is a multi-channel detector having circuitry for generating Call signals for each channel; and wherein said method includes the step of providing a plurality of audible indicator units each dedicated to a specific one of the channels for generating an audible indication of the state of the Call signal for the associated channel.

11. The invention of claim 10 wherein said step of providing a plurality of audible indicator units includes the step of generating a tone having a pitch unique to the channel associated to a given audible indicator unit.

12. The invention of claim 9 wherein said vehicle detector is a multi-channel detector having circuitry for generating Call signals for each channel; and wherein said step of using a generated Call signal to activate a sound transducer to audibly indicate the generation of the Call signal in response to the entry of a vehicle in the loop includes the step of using a multiplexer unit having a plurality of input terminals each coupled to a different channel Call signal, and a single tone generator coupled to said multiplexer unit to generate an audible tone whenever one of said channel Call signals is asserted.

13. The invention of claim 12 wherein said step of using a generated Call signal includes the step of activating a variable tone generator coupled to said multiplexer unit to generate an audible tone having a pitch unique to a given channel whenever a channel Call signal for that given channel is asserted.

14. The invention of claim 9 wherein said vehicle detector is a multi-channel detector having circuitry for generating Call signals for each channel; and wherein said step of using a generated Call signal to activate a sound transducer to audibly indicate the generation of the Call signal in response to the entry of a vehicle in the loop includes the step of specifying a given channel for exclusively activating the sound transducer and preventing any channel other than the selected channel from activating said tone generator.

15. The invention of claim 9 further including the step of disabling the sound transducer a predetermined time period after activation.

* * * * *